United States Patent [19]

Saterini et al.

[11] Patent Number: 4,729,309

[45] Date of Patent: Mar. 8, 1988

[54] IMPRINTER

[75] Inventors: Mario Saterini; Gianfranco Gibellino; Mario Forno, all of Casale Monferrato, Italy

[73] Assignee: Officine Meccaniche G. Cerutti S.p.A., Casale Monferrato, Italy

[21] Appl. No.: 15,393

[22] Filed: Feb. 17, 1987

[30] Foreign Application Priority Data

Feb. 17, 1986 [IT] Italy ..... 19432 A/86

[51] Int. Cl.[4] ..... B41F 5/18; B41F 9/02; B41F 13/32

[52] U.S. Cl. ..... 101/152; 101/182; 101/352

[58] Field of Search ..... 101/178, 179, 180, 181, 101/182, 184, 185, 221, 225, 228, 218, 247, 139, 140, 143, 145, 351, 352, 152

[56] References Cited

U.S. PATENT DOCUMENTS 3,329,086 7/1967 Pullen ..... 101/182
4,369,705 1/1983 Gelinas ..... 101/247

*Primary Examiner*—J. Reed Fisher
*Attorney, Agent, or Firm*—Peter K. Kontler

[57] ABSTRACT

An imprinter, particularly for use downstream of a flexographic printing machine, wherein the stubs at the ends of the counterpressure roller which forms part of the web guiding system are suspended on levers. The levers are pivotable about a horizontal axis defined by a pivot member on one or more carriages which are movable in the frame up and down to move the counterpressure cylinder nearer to or further away from two printing cylinders. The printing cylinders flank the counterpressure cylinder and their stubs are removably installed in open-sided sockets which are provided therefor in the sidewalls of the frame. Each printing cylinder receives ink from a discrete source.

24 Claims, 4 Drawing Figures

IMPRINTER

BACKGROUND OF THE INVENTION

The invention relates to printing machines in general, and more particularly to improvements in auxiliary or additional printing machines of the type known as imprinters.

It is often necessary to provide or combine a cylinder printing machine with an auxiliary apparatus (imprinter) which is disposed at the discharge end of the main machine and can constitute an additional flexographic printer. As a rule, the imprinter comprises two printing cylinders which flank a single counterpressure cylinder and carry printing plates serving to apply additional printed matter to a running web of paper or other material which issues from the main printing machine. The counterpressure cylinder guides the running web along a preselected path wherein the web can receive printed matter from the one or the other printing cylinder. Each printing cylinder receives printing ink from an ink supplying unit which, in a flexographic imprinter, can comprise a so-called anilox cylinder and a rubber roller. That printing cylinder which carries one or more printing plates is caused to contact the running web while the other printing cylinder is idle (e.g., while the operators exchange the printing plate or plates on the other printing cylinder). The counterpressure cylinder rotates about a fixed axis. The active printing cylinder can be used to apply additional printed matter to certain pages or groups of pages of special editions of newspapers or other types of printed publications, e.g., to local editions of nationally or internationally distributed publications.

An advantage of imprinters is that they constitute a simple, inexpensive and effective means for applying printed matter to a limited number of discrete or coherent sheets which issue from the main printing machine. For example, the two printing cylinders of a conventional imprinter can be used to apply additional printed matter in two different colors or to apply two different types of printed matter in the same color or in different colors.

A drawback of conventional imprinters is that the peripheral speed of each printing cylinder cannot be readily and accurately synchronized with the peripheral speed of the counterpressure cylinder. Thus, if a printing cylinder having a first diameter is to be replaced with a printing cylinder having a different second diameter, it is necessary to exchange a substantial number of gears, antifriction bearings and other parts which are normally mounted in the interior of the frame so that they are not readily accessible. This involves a substantial amount of work by several skilled or highly skilled workmen and entails a longer-lasting stoppage of the entire printing machine. As a rule, a change of the setup takes up several hours.

Another drawback of conventional imprinters is that the starting and stoppage of the cylinders in the imprinter take up an inordinately large amount of time and can be carried out only by relying on complex and expensive instruments. This is also due to the fact that the peripheral speed of a freshly inserted printing cylinder must match exactly the peripheral speed of the counterpressure cylinder.

A further drawback of conventional imprinters is their lack of versatility.

OBJECTS AND SUMMARY OF THE INVENTION

An object of the invention is to provide an imprinter which is constructed and assembled in such a way that a shifting from operation with one printing cylinder to operation with another printing cylinder takes up much less time than in conventional imprinters.

Another object of the invention is to provide an imprinter which can employ printing cylinders having different diameters and which can be adjusted or converted for operation with different printing cylinders by a small number of workers.

A further object of the invention is to provide an imprinter wherein the selected printing cylinder can be accelerated to a desired speed in a time-saving operation and with a high degree of accuracy and reproducibility.

An additional object of the invention is to provide the imprinter with novel and improved means for selecting and maintaining the position of the counterpressure cylinder.

Still another object of the invention is to provide an imprinter which can be used in conjunction with existing cylinder printing and other printing machines.

A further object of the invention is to provide an imprinter wherein the printing cylinder or cylinders can be installed in or removed from the frame within a fraction of the time which is required to carry out such operation in a conventional imprinter.

An additional object of the invention is to provide a printing machine which embodies or is combined with the above outlined imprinter.

A further object of the invention is to provide an imprinter wherein excessive evaporation of solvents and other volatile ingredients of printing ink can be prevented in a simple and efficient way.

An additional object of the invention is to provide an imprinter which can employ larger- or smaller-diameter printing cylinders and wherein the selected printing cylinder can be accelerated to nominal speed in a fully automatic way.

Another object of the invention is to provide an imprinter wherein the position of a printing cylinder relative to the counterpressure cylinder and/or vice versa can be selected and maintained with a heretofore unmatched degree of accuracy and reproducibility.

An additional object of the invention is to provide a novel and improved mode of mounting the printing cylinders of the imprinter in the frame of such apparatus.

The improved imprinter serves to apply printed matter to a running web or strip of paper or the like and can be used downstream of a main printing machine. The imprinter comprises a frame, means defining a path for the web and including a preferably horizontal counterpressure cylinder having coaxial first and second end portions in the form of stubs or the like, first and second levers or links which rotatably support the respective end portions of the cylinder, pivot means for the levers (such pivot means defines for the levers an axis which is parallel to the common axis of the end portions of the cylinder), at least one carriage or other suitable means for movably supporting the pivot means in the frame, guide means defining for the supporting means a preferably straight path or course extending at right angles to the axis of the pivot means and preferably vertically at a level above the cylinder, and first and second rotary printing cylinders installed in the frame and flanking the counterpressure cylinder. The axes of the printing cylinders are parallel to the axis of the pivot means. The frame can comprise two spaced-apart sidewalls or cheeks, and the three cylinders are disposed between such sidewalls. The frame is preferably provided with a pair of aligned sockets for each printing cylinder, and the printing cylinders have end portions (e.g., in the form of stubs) in the respective sockets. Each socket is preferably provided with an open outer side in order to allow for insertion or removal of the end portions of the respective printing cylinders from the corresponding pairs of sockets. Each sidewall of the frame can have a socket for one end portion of one printing cylinder and a socket for one end portion of the other printing cylinder. The bearings for the printing cylinders preferably surround the respective end portions and are disposed in the respective sockets. The dimensions of the open outer sides of the sockets are preferably selected in such a way that the end portions of the printing cylinders and the respective bearings are readily insertable into or withdrawable from the respective sockets without the need for even partial dismantling of the imprinter.

The imprinter further comprises a support in the frame beneath each printing cylinder, guide means defining for the supports substantially vertical courses or paths along which the supports are movable toward and away from the counterpressure cylinder, a holder mounted on each support for pivotal movement about an axis which is substantially parallel to the axes of the printing cylinders, and sources of printing ink on the holders. Motor-operated drive means can be provided to move the supports along the respective courses, and such drive means can comprise at least one feed screw.

The imprinter can further comprise means (preferably including one or more fluid-operated motors) for releasably clamping the supporting means to the respective guide means.

In accordance with a presently preferred embodiment, the imprinter comprises a prime mover (such as a motor for the moving parts of the main printing machine), first and second motors, first and second clutch means which are engageable to releasably couple the first and second motors to the first and second printing cylinders, respectively, so as to accelerate the respective printing cylinders from zero speed or from a relatively low speed to the normal operating speed of the printing cylinders, and second and third clutch means which are engageable to respectively couple the accelerated first and second printing cylinders to the prime mover. At least one of the first and second motors is or can be a variable-speed motor, e.g., a d-c motor.

The imprinter preferably further comprises motor means for pivoting the counterpressure cylinder and the levers about the axis of the pivot means, and adjustable stop means for limiting the extent of pivotability of the counterpressure cylinder about the axis of the pivot means. The aforementioned ink supplying means can comprise at least one ink supplying roller or cylinder at a level below each printing cylinder, and such imprinter preferably further comprises means (such as the aforementioned holders) for pivotably mounting the ink supplying cylinders in the frame for movement about axes which are parallel to the axes of the printing cylinders, motor means for pivoting the ink supplying cylinders, and adjustable stop means for limiting the extent of pivotability of the ink supplying cylinders.

Motor means can be provided to move the means for supporting the supporting means up and down, and such imprinter can further comprise at least one substantially vertical feed screw in the frame, a pin-and-slot connection between the feed screw and the supporting means, and means for moving the feed screw up and down. The means for moving the feed screw can comprise a worm wheel on the feed screw and a worm which is rotatably mounted in the frame and mates with the worm wheel.

The motor for the counterpressure cylinder is preferably arranged to rotate the counterpressure cylinder independently of the printing cylinders, and such motor is preferably a variable-speed motor. Additional variable-speed motors can be provided to rotate the printing cylinders independently of each other and independently of the counterpressure cylinder.

The printing cylinders can constitute rotogravure rollers, and such imprinter then further comprises means for supplying printing ink to the printing cylinders and a squeegee cooperating with each printing cylinder to remove the surplus of printing ink. The squeegees can be installed adjacent the upper portions of the respective printing cylinders, and the imprinter using such squeegees can further comprise means (e.g., discrete vessels) for collecting the surplus of printing ink and means for directing the removed surplus of printing ink from the squeegees into the collecting means. If the squeegees are adjacent the lower portions of the respective printing cylinders, they are preferably designed in such a way that each squeegee and the respective ink supplying means together form a compact module.

Means can be provided to encapsulate or nearly completely encapsulate each printing cylinder and the respective squeegee and ink supplying means. Each encapsulating means can comprise a vessel for the respective squeegee and ink supplying means, a hood which extends around the respective printing cylinder, and means for separably coupling the hood to the respective vessel and/or to the frame.

The novel features which are considered as characteristic of the invention are set forth in particular in the appended claims. The improved imprinter itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figure 1:
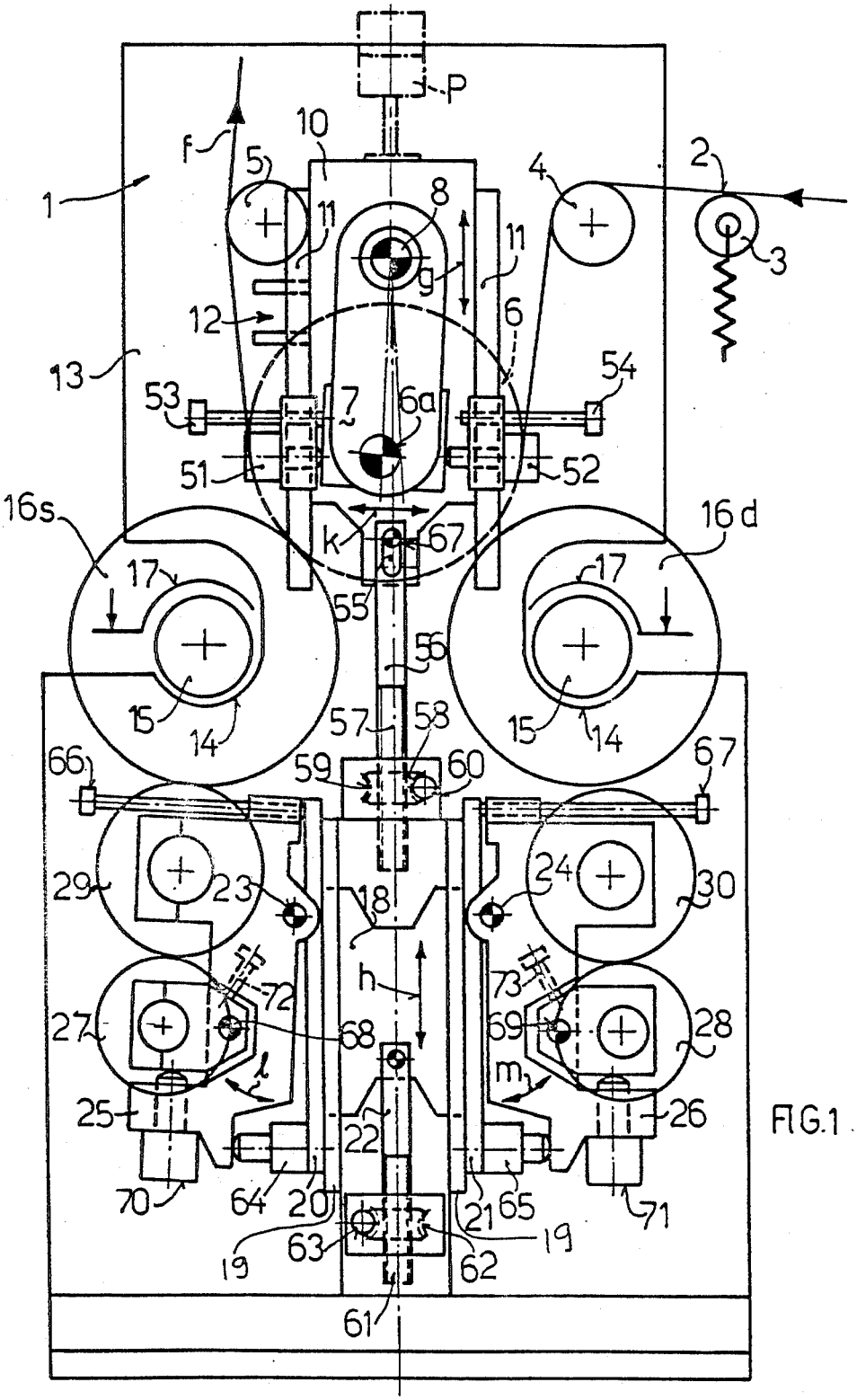
FIG. 1 is a schematic end elevational view of an imprinter which embodies one form of the invention, with one sidewall of the frame omitted.

Referring first to FIG. 1, there is shown an imprinter which includes an upright frame 1 having two spaced-apart sidewalls or cheeks 13 (only one shown). The means which defines a predetermined path for a running web or strip 2 of paper or other flexible material comprises a spring-biased tensioning roll 3, two deflecting rolls 4, 5 and a counterpressure cylinder 6 having two coaxial end portions 6*a* in the form of stubs which are rotatably journalled in the lower end portions of two spaced apart levers or links 7. The common axis of the stubs 6*a* is horizontal and parallel to the axis of a pivot means 8 for the upper end portions of the levers 7. The counterpressure cylinder 6 is flanked by two printing cylinders 16*s*, 16*d* and is disposed at a level below and substantially midway between the deflecting rollers 4, 5 of the means for guiding the web 2. The web 2 advances in the direction which is indicated by the arrow f and the levers 7 (together with the cylinder 6) are movable up and down in directions which are indicated by the double-headed arrow g. The levers 7 can perform a pendulum movement in directions which are indicated by the double-headed arrow k by turning about the axis of the pivot means 8 as a unit. The motor means for pivoting the levers 7 about the axis of the pivot means comprises two fluid-operated (particularly hydraulic) cylinder and piston units 51, 52 which are mounted (either directly or indirectly) in the frame 1, and the means for limiting the extent of pivotability of the levers 7 in a clockwise or in a counterclockwise direction comprises two adjustable stops 53, 54 having externally threaded portions in mesh with complementary nuts on the frame 1. The units 51 and 52 can be started by remote control, e.g., from a suitable control panel (not shown) of the main printing machine. The pison rods of the units 51 and 52 can act directly upon the lateral surfaces of lower portions of the levers 7; it often suffices to provide a pair of units 51, 52 for one lever 7 if the other lever 7 is invaraibly compelled to share all pendulum movements of the one lever about the axis of the pivot means 8. Each of the stops 53 and 54 can be mounted adjacent a suitable scale or other means for indicating the axial position of the respective stop and hence the selected angular position of the respective lever 7.

The pivot means 8 for the levers 7 is mounted in or on supporting means 10 including one or more carriages movable up and down along a vertical path or course which is defined by vertical guide means 11 in the form of rails or the like and mounted on or forming part of the respective sidewall 13. The means for moving the supporting means 10 along the guide means 11 can comprise one or more hydraulic, pneumatic or electric motors. FIG. 1 shows by phantom lines a pneumatic motor P which is installed in the frame 1 at a level above the guide means 11 and whose downwardly extending piston rod is secured to the supporting means 10. The extent to which the supporting means 10 is movable up and down (arrow g) is normally small, and the motor P is preferably operable by remote control, e.g., in response to actuation of a suitable knob, button, pusher or an otherwise configurated control element on the aforementioned control panel. The imprinter further comprises clamping means for releasably locking the supporting means 10 in a selected position in which the counterpressure cylinder 6 is disposed at a predetermined level and at a predetermined distance from the printing cylinders 16*d* and 16*d*. The illustrated clamping means comprises one or a battery of two or more fluid-operated (particularly hydraulic) motors 12 which can be used to bias the supporting means 10 against at least one of the guide means 11 and to thus immobilize the pivot means 8 for the levers 7 and counterpressure cylinder 6 at a selected level. The motor or motors 12 can be mounted on one of the sidewalls 13 to bias the supporting means 10 against the guide means 11 and/or to simply engage and fix the supporting means at a selected level.

The extent to which the motor P can move the supporting means carriages 10 along the guide means 11 is determined by the length of a vertical slot or window 55 provided in the upper end portion of an upright feed screw 56. The slot 55 receives a horizontal pin 67 which is fixed to or forms an integral part of the lower portion of the supporting means 10. The lower portion of the feed screw 56 has an external thread 57 in mesh with the internal thread 58 of a worm wheel 59 which further mates with a worm 60 mounted in the frame 1. Means (e.g., a suitable reversible motor, not shown) can be provided to rotate the worm 60 and to thereby cause the worm wheel 59 to move the feed screw 56 up or down in order to raise or lower the slot 55 with reference to the pin 67 of the supporting means 10. The worm wheel 59 is rotatably mounted in a column 18 which can form part of or is connected to the frame 1. The reversible motor for the worm 60 can be started or arrested in response to actuation of the corresponding control element on the control panel. Such motor can be a d-c motor. Suitable rotary encoding means or the like can be provided to allow for a highly accurate selection of the axial position of the feed screw 56 and hence of the level of the counterpressure cylinder 6 with reference to the printing cylinders 16*d* and 16*s*.

Each sidewall 13 of the frame 1 is provided with two sockets 14 which have open sides and serve for reception of the stubs 15 (end portions) of the printing cylinders 16*d* and 16*s*. The dimensions of the sockets 14 are preferably selected in such a way that the sockets can also confine the customary bearings for the stubs 15. The reference characters 17 denote suitable retaining and clamping devices which releasably hold the stubs 15 and the associated bearings in the respective sockets 14. An advantage of these sockets and of their open sides is that the printing cylinders 16*s*, 16*d* can be inserted or removed from the frame 1 with a minimum of effort and within surprisingly short intervals of time. The sidewalls 13 further carry mechanical, pneumatic or hydraulic means for releasably holding the retaining and clamping devices 17 in their operative positions in which the axes of the printing cylinders 16*d* and 16*s* are parallel to the axis of the counterpressure cylinder 6 and to the axis of the pivot means 8.

The aforementioned column 18 in the frame 1 is disposed midway between the printing cylinders 16*d*, 16*s* at a level below the counterpressure cylinder 6 and is flanked by vertical guide means 19 for vertically reciprocable slides or similar supports 20, 21. The means for moving the slides 20, 21 up or down (note the arrow h) comprises a vertical feed screw 22 which is coupled to the slides and has external threads 61 mating with the internal threads of a worm wheel 62 which is rotatably journalled in the column 18. The worm wheel 62 further mates with a worm 63 which can be rotated by a preferably adjustable reversible d-c motor (not shown)

to change the level of the slides 20, 21 and hence of the means for supplying ink to the printing cylinders **16*d*, 16*s*. The motor for the feed screw 22 is preferably combined with rotary encoder means (not shown) or with a suitable transductor so as to allow for highly accurate adjustment of the level of the slides 20, 21 relative to the column 18** as well as for accurate determination of the selected position of the level of the slides.

The slides 20, 21 respectively support holders 25, 26 which are pivotable about the horizontal axes of pivot members 23 and 24, respectively. These axes are parallel to the axes of the printing cylinders **16*d*, 16*s*. The directions in which the holders 25, 26 are pivotable with reference to the corresponding slides 20, 21 are indicated by arrows l and m. The slides 20, 21 further support fluid-operated or electric motors 64, 65 which can be actuated from the control panel to change the inclination of the holders 25, 26 to an extent which is determined by the setting of stops 66, 67 which are rotatably mounted in the respective holders 25, 26 and whose tips can abut the respective slides 20, 21. Scales or like means can be provided to facilitate accurate selection of angular positions of the holders 25, 26 relative to the respective slides 20 and 21**.

The holders 25 and 26 serve as a means for carrying ink supplying means for the printing cylinders **16*s* and 16*d*. The ink supplying means for the printing cylinder 16*s* comprises cylinders or rollers 27, 28 which have elastic outer layers made of rubber or the like and which receive printing ink from suitable sources, (e.g., fountains), not shown. The peripheral surfaces of the cylinders 27, 28 respectively transfer printing ink onto the peripheral surfaces of additional cylinders 29, 30 (e.g., conventional anilox cylinders) which, in turn, transfer ink to the printing plates of the cylinders 16*s* and 16*d*, respectively. The axes of the cylinders 27, 29 and 28, 30 are respectively remote from the pivot members 23 and 24 so that the levels of such cylinders with reference to the respective printing cylinders 16*s*, 16*d* change in response to pivoting of the holders 25 and 26 about the axes of the pivot members 23 and 24, respectively. It will be seen that the cylinders 27, 29 and 28, 30 of the two ink supplying means can be moved up and down (with the respective slides 20 and 21) as well as about the axes of the respective pivot members 23 and 24**. All such movements can be initiated and terminated by remote control.

The cylinders 27 and 28 are respectively mounted levers pivotable about pins 68 and 69 which are anchored in the corresponding holders 25, 26 so that each of these cylinders can be moved up or down with reference to the adjacent cylinder 29, 30. Threaded bolts 72, 73 or analogous stop means are provided to fix the cylinders 27 and 28 in selected positions. The means for pivoting the cylinders 27, 28 about the axes of the respective pivot members 68, 69 comprises fluid-operated or electric motors 70 and 71 which are mounted on the respective holders 25 and 26. The levers or arms which mount the stubs of the cylinders 27, 28 on the respective pivot pins 68, 69 are shown but are not referenced in FIG. 1.

As a rule, the diameters of the printing cyinders **16*s* and 16*d* match the diameters of the corresponding printing cylinders in the main printing machine which precedes the imprinter of FIG. 1, i.e., in the printing machine from which the web 2 issues on its way toward the path which is defined by the rolls 3, 4, 5 and counterpressure cylinder 6. Therefore, it is advisable and advantageous to drive the printing cylinders 16*s*, 16*d* by the prime mover PM (FIG. 2) which drives the printing cylinders of the main printing machine. This ensures that the peripheral speed of the printing cylinders 16*s* and 16*d*** can readily or more readily match the peripheral speed of the corresponding printing cylinders in the main printing machine.

In order to couple the shafts of the printing cylinders **16*s* and 16*d* to the main prime mover PM, it is necessary to accelerate each of the cylinders 16*s*, 16*d* to (or close to) the speed of the respective printing cylinders in the main printing machine. To this end, the imprinter comprises discrete variable-speed motors 86 (one shown in FIG. 2) for the stubs 15 of the corresponding printing cylinders. The cylinder 16*d* of FIG. 2 can be driven by the prime mover PM of the main printing machine in response to engagement of a first clutch which has two sections 79, 80 provided with claws, teeth or analogous torque transmitting elements. The section 79 is rotatable with and is movable axially of the stub 15 of the printing cylinder 16*d* into and from torque-receiving engagement with the clutch section 80. The latter is driven by the main prime mover PM through the medium of mating bevel gears 81 and 82. The stub 15 of the printing cylinder 16*d* has an extension 15*a* which can be rotated by an axially movable clutch section 83 of a second clutch further including a clutch section 84 on the output shaft 85 of the motor 86. The section 83 is movable axially of the extension 15*a* into and from torque-receiving engagement with the section 84. The construction of the means for accelerating the other stub 15 of the printing cylinder 16*d* and of the means for accelerating the stubs 15 of the printing cylinder 16*s* (not shown in FIG. 2) is preferably identical with the construction of the just described means for accelerating the stub 15 of FIG. 2**.

Figure 2:
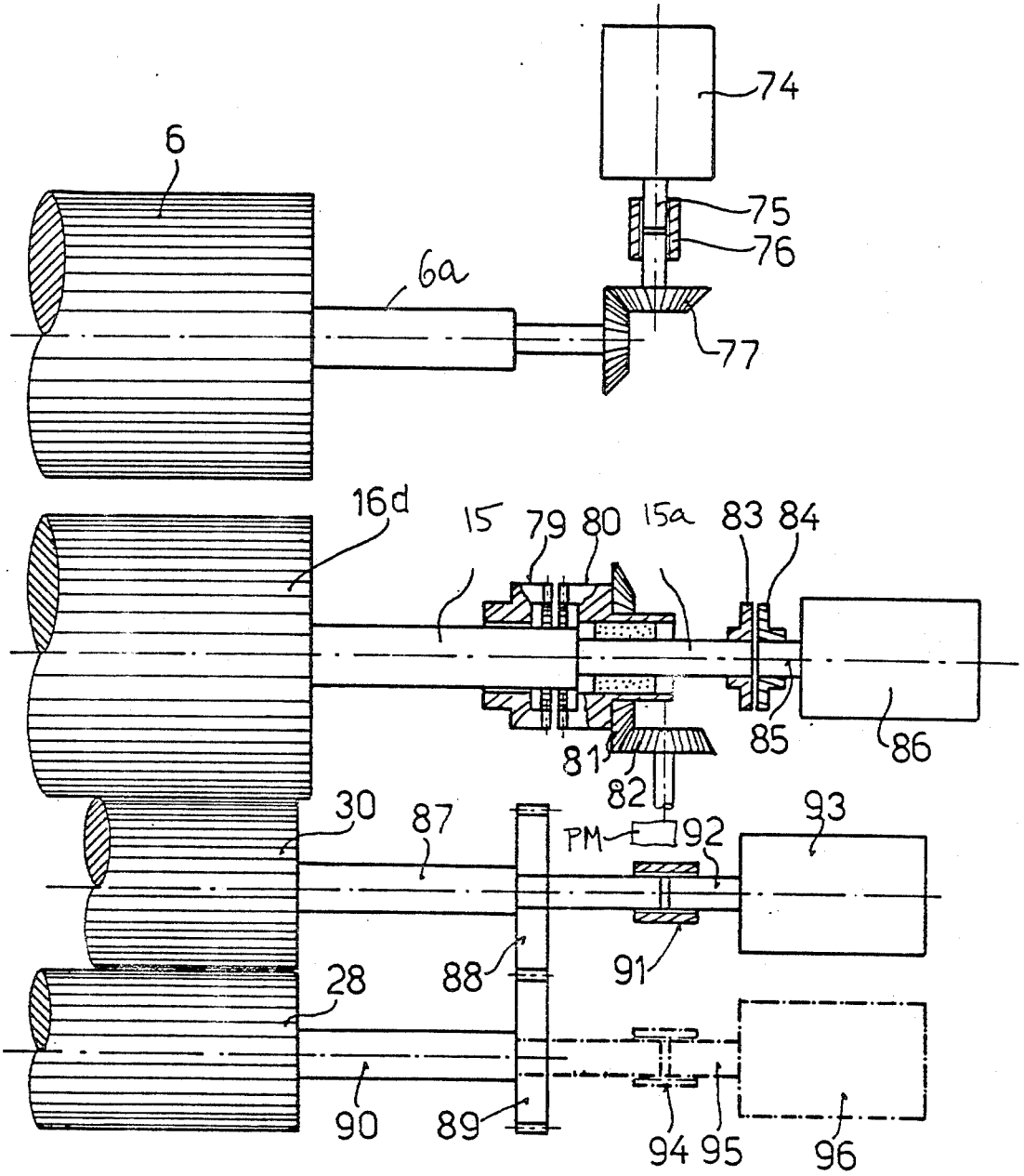
FIG. 2 is a fragmentary side elevational view as seen from the left-hand side of FIG. 1, with the frame and the ink supplying means for the printing cylinders omitted.

FIG. 2 further shows that at least one stub **6*a* of the counterpressure cylinder 6 can be driven by a prime mover (e.g., a variable-speed electric d-c motor 74) independently of the means for rotating the printing cylinders 16*s*, 16*d*. The means for rotating the stub 6*a* of the counterpressure cylinder 6 comprises a mechanical or electromagnetic clutch 76 which can transmit torque between the output element 75 of the motor 74 and the shaft of the first of two bevel gears 77 the second of which is mounted on the stub 6*a*. If desired, the cylinder 6** can receive torque from the prime mover PM, preferably by way of a suitable mechanical, electromagnetic or other clutch. This modification is not specifically shown in the drawing.

The stub 87 of the cylinder 30 which is shown in FIG. 2 carries a gear 88 in mesh with a gear 89 on the stub 90 of the cylinder 28 to ensure that the angular movements of the cylinders 28 and 30 are properly synchronized. This obviates the need for discrete motors for the cylinders 28 and 30, i.e., the cylinder 30 can be driven by a variable-speed electric or other motor 93 through the medium of a mechanical, electromagnetic or other clutch 91 which receives torque from the output element 92 of the motor 93, and the gear train 88, 89 transmits torque to the stub 90 of the cylinder 28. However (and as shown in FIG. 2 by phantom lines), it is equally within the purview of the invention to provide a discrete variable-speed electric or fluid-operated motor 96 whose output element 95 transmits torque to the stub 90 for the cylinder 28 by way of a mechanical, electromagnetic or other suitable clutch 94, and to omit the gear train 88, 89 (or to provide a clutch between the gear 88 and the stub 87 and/or between the gear 89 and the stub 90).

Each of the motors 74, 86, 93 and 96 is preferably associated with a rotary encoder, with a rotary transductor or with other suitable means for facilitating accurate determination of the selected rotational speed of the respective cylinders. The encoder means or the like can transmit signals to devices which are installed in, on or adjacent the aforementioned control panel of the main printing machine or adjacent to, on or in a separate control panel for the imprinter.

The mode of operation of the improved imprinter is as follows:

The supporting means 10 is moved to a predetermined position through the medium of the worm drive 59, 60 and feed screw 56 to thus establish a preselected position of the counterpressure cylinder 6 with reference to the printing cylinders **16*d* and 16*s*. If necessary, the motor P is actuated to effect a final highly accurate adjustment of the position of the counterpressure cylinder 6. The maximum length of the adjustment via motor P is determined by the difference between the diameter of the pin 67 and the length of the slot 55**.

In the next step, the stops 53 and 54 are shifted axially (if necessary) in order to determine the inclination of the arms 7 for the stubs **6*a* of the counterpressure cylinder 6. As mentioned above, the means for changing the inclination of the arms 7 includes the units 51 and 52. The holders 25, 26 can be moved up or down (simultaneously with actuation of the units 51, 52 or thereafter) by starting the motor for the worm 63 which cooperates with the worm wheel 62 and feed screw 22 to change the level of the slides 20, 21 and hence of the respective holders 25 and 26. The stops 66, 67 are moved to selected positions to determine the inclination of the holders 25, 26 relative to the respective slides 20, 21. The inclination of the holders 25, 26 can be changed by the respective motors 64, 65. The selected angular positions of the cylinders 27, 28 are determined by the stops 72, 73; as mentioned above, the inclination of the levers for the end portions of the cylinders 27 and 28 can be changed by the motors 70 and 71**.

If the operator or operators select the right-hand printing cylinder **16*d* of FIG. 1 for the application of printing ink to selected portions of the running web 2 (while the left-hand printing cylinder 16*s* remains idle or while the operators are in the process of exchanging printing plates on the cylinder 16*s*), the operator or operators will carry out the following steps: The admission of ink to the cylinder 28 is interrupted before the motor 93 of FIG. 2 is started to rotate the cylinder 30 via clutch 91 and stub 87 and to simultaneously rotate the stub 90 of the cylinder 28 by way of the gear train 88, 89. The cylinders 28 and 30 are normally rotated at a relatively low speed in order to prevent printing ink from drying thereon, especially on the elastic radially outermost layer of the cylinder 28**.

If the gear train 88, 89 is to be omitted or deactivated, the cylinder 28 of the means for supplying ink to the printing cylinder **16*d* is driven by the motor 96 through the medium of the output shaft 95, clutch 94 and stub 90**.

The motor 74 is also started to gradually accelerate the counterpressure cylinder 6 to its normal operating speed through the medium of the output shaft 75, clutch 76 and bevel gears 77. When the acceleration of the printing cylinder **16*d* by the motor 86 is completed, the peripheral speed of the cylinder 16*d* matches or closely approximates the peripheral speed of the corresponding printing cylinder in the main printing machine. At such time, the clutch 83, 84 is disengaged and the clutch 79, 80 is engaged so that the printing cylinder 16*d* is then driven by the main prime mover PM, the same as the corresponding printing cylinder of the main printing machine. The arrangement is preferably such that the speed of the stub 15 is monitored by a tachometer generator or by any other suitable means for generating signals which denote the peripheral speed of the cylinder 16*d*, and that the clutch 79, 80 is engaged in automatic response to acceleration of the cylinder 16*d* to its nominal speed. At the same time, the motor 93 accelerates (or the motors 93, 96 accelerate) the cylinders 28, 30 of the means for supplying ink to the printing cylinder 16*d* to a speed which is somewhat less than the speed of the cylinder 16*d*, and the motor 65 is actuated thereafter to pivot the holder 26 counterclockwise (as seen in FIG. 1) in order to lift the cylinder 30 and to thus move its peripheral surface into ink-transmitting and torque-receiving engagement with the printing cylinder 16*d***.

The counterpressure cylinder 6 is pivoted to the right (as seen in FIG. 1) in response to actuation of the unit 51 so that it moves the running web 2 into contact with the printing cylinder **16*d*. Such pivoting of the counterpressure cylinder 6 can take place prior to a movement of the cylinder 30 into actual contact with the cylinder 16*d*. Pivoting of the cylinder 6 about the axis of the pivot means 8 can be preceded by a lowering of the cylinder 6 and of the supporting means 10 (through a small distance) by the motor P so as to move the web 2 into actual contact with the printing cylinder 16*d*. At such time, the printing cylinder 16*d* carries one or more printing plates which are used to apply printed matter to selected portions of the running web 2. The imprinter is then ready to apply printed matter to a selected number of successive portions of the web 2**.

At the same time, the printing cylinder **16*s* is idle. The cylinders 27 and 29 of the means for supplying ink to the cylinder 16*s* are driven at a relatively low speed so as to prevent drying of ink in the recesses of the cylinder 27 while the printing cylinder 16*s* is inactive. The means for maintaining the peripheral surfaces of the cylinders 27 and 29 in actual contact includes the motor 70 on the holder 25**.

If the operators thereupon decide to deactivate the printing cylinder **16*d* and to cause the printing plate or plates of the printing cylinder 16*s* to transfer ink onto the web 2 which advances along the path defined by the rolls 3, 4, 5 and counterpressure cylinder 6**, they proceed as follows:

The printing cylinder **16*s* is provided with one or more printing plates and this cylinder is thereupon accelerated to, or close to, its nominal speed in a manner as described in connection with the motor 86, its output shaft 85, clutches 79, 80 and 83, 84, bevel gears 81, 82, prime mover PM and stub 15 of FIG. 2. Thus, the printing cylinder 16*s* is driven by the prime mover PM at the nominal speed as soon as its acceleration by the respective motor or motors 86 is completed. The cylinders 27, 29 of the means for supplying ink to the printing cylinder 16*s* are also accelerated to their nominal speeds, preferably in a manner as described in connection with the cylinders 28 and 30 of FIG. 2. Thus, each of the cylinders 27, 29 can be accelerated by a discrete motor, or these cylinders can be accelerated jointly by a single motor corresponding to the motor 93 of FIG. 2. The printing cylinder 16*s* is thereupon lifted toward the counter-pressure cylinder 6 and the cylinders 27, 29 are lifted so that the peripheral surface of the cylinder 29 engages the cylinder 16s. Such lifting is effected by the motor 64 which can pivot the holder 20 relative to the respective slide 20. The cylinder 6 is pivoted to its left-hand position (by the unit 52 while the piston rod of the unit 51 is free to yield) so that the running web 2 is pressed against the printing cylinder 16s. The imprinter is then ready to apply printed matter to selected portions of the web 2 as a result of contact between such selected portions and the printing plate or plates of the cylinder 16s**.

While the printing cylinder 16s is operative, the operators remove or cause the cylinders 30, 28 to move away from the printing cylinder 16d as a result of actuation of the motor 65 (i.e., retraction of the piston rod of this motor). The rotational speed of the cylinders 28, 30 is reduced to a minimum speed which suffices to prevent the ink from drying on these cylinders. The clutch 79, 80 is disengaged to disconnect the printing cylinder 16d from the main prime mover MP, and the cylinder 16d comes to a halt because the clutch 83, 84 is disengaged. The operator or operators are then in a position to detach the printing plate(s) from the printing cylinder 16d and to replace such plates with fresh plates which are to be used during the next period of activation or utilization of the printing cylinder 16d.

Figure 3:
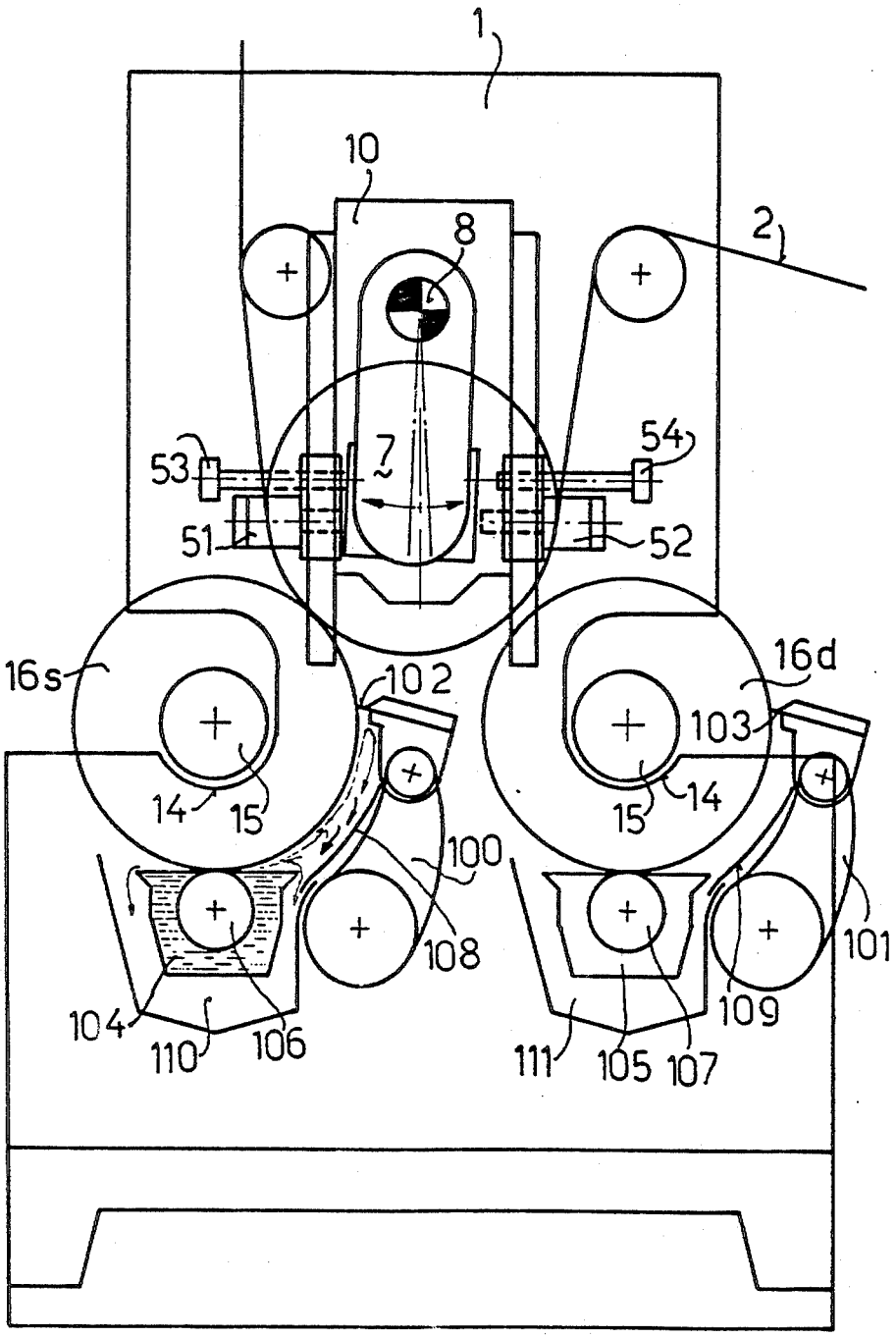
FIG. 3 is a schematic end elevational view of a modified imprinter wherein the printing cylinders constitute the rollers of a rotogravure printer.

The imprinter of FIGS. 1 and 2 is a flexographic imprinter. However, it is equally within the purview of the invention to utilize the improved imprinter in conjunction with a rotogravure printing machine. The difference is that the printing cylinders of the imprinter are rotogravure rollers or cylinders. For the sake of simplicity, the rotogravure rollers of the imprinter which is shown in FIG. 3 are denoted by the same reference characters (16d and 16s) as the flexographic printing cylinders of the imprinter of FIGS. 1 and 2. Each of rollers 16s, 16d is combined with a suitable ink supplying unit 100, 101 and each of these units comprises an ink fountain 104, 105, a squeegee 102, 103 whose blade engages the upper portion of the respective roller, and a chute 108, 109 which directs the diverted body of printing ink from the edge of the respective squeegee 102, 103 into the collecting vessel 110, 111 of the respective unit 100, 101. The reference characters 106, 107 denote two roller-shaped applicators which deliver films of printing ink from the respective fountains 104, 105 to the adjacent rollers 16s, 16d. The exact construction of the units 100, 101 is or can be conventional and forms no part of the present invention. As shown in FIG. 3, the squeegees 102, 103 are pivotably mounted in the frame of the imprinter in order to allow for accurate selection of the pressure with which the edges of these squeegees bear against the respective rollers 16s and 16d. Moreover, the squeegees 102 and 103 can be readily pivoted away from the respective rollers in order to allow for convenient withdrawal of the end portions 15 of the rollers from the respective pairs of sockets 14 in the sidewalls of the frame 1.

FIG. 3 shows the left-hand roller 16s in actual use, i.e., this roller is in the process of applying to the running web 2 additional printed matter while the roller 16d is out of contact with the web and is ready to be removed from the frame 1 (subsequent to pivoting of the squeegee 103 to its retracted position) so as to allow for inspection and/or replacement of its printing plate(s).

Figure 4:
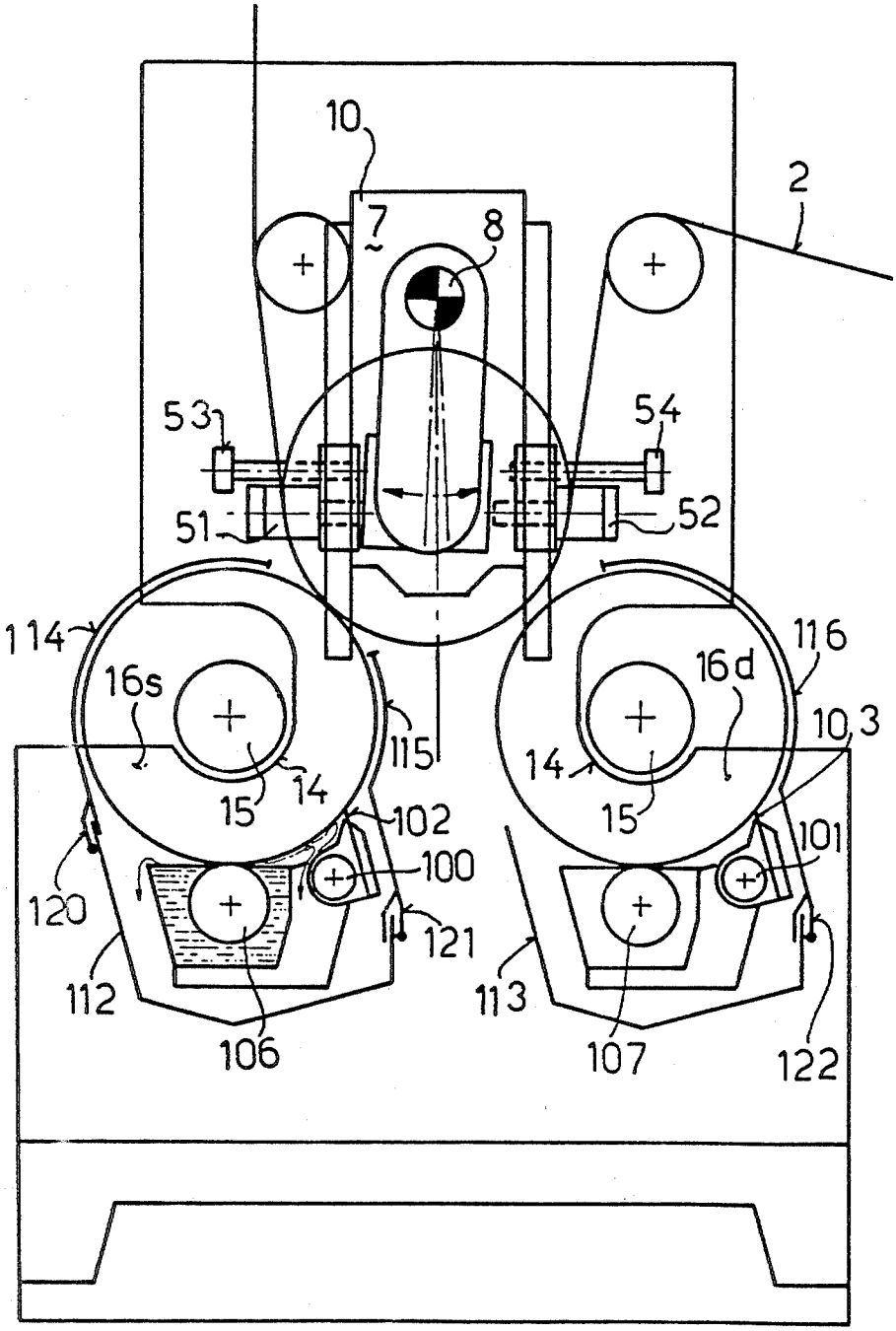
FIG. 4 is a schematic end elevational view of an imprinter constituting a modification of the imprinter of FIG. 3 and having nearly fully encapsulated rotogravure printing cylinders and associated squeegees and ink supplying means.

FIG. 4 shows an imprinter which constitutes a modification of the imprinter of FIG. 3 and wherein the means for supplying printing ink to the rotogravure rollers 16d and 16s is constructed in a somewhat different way. The units 100 and 101 are compact and their squeegees 102, 103 respectively cooperate with the lower portions of the respective rollers 16s, 16d. In order to avoid pronounced evaporation of volatile solvent which is contained in the printing ink that it being entrained by the roller 16d or 16s from the locus of contact with the respective squeegee 103 or 102 to the locus of engagement with the running web 2 (which could affect the quality of the printed matter), the imprinter of FIG. 4 further comprises means for substantially encapsulating the units 100, 101 and the respective rollers 16s, 16d save at and close to the locations of contact of the rollers 16s, 16d the web 2 at or close to the 7½ and 4½ o'clock positions of the counterpressure cylinder. The printing ink is contained in the recesses provided therefor in the periphery of the roller which happens to be in actual use. The encapsulating means can comprise envelopes which are made of sheet metal and respectively comprise vessels 112, 113 for the respective units 100, 101 and hoods or shrouds including sections 114, 115 and analogous sections for the roller 16d. The sections 114, 115 are separably connected to the respective marginal portions of the vessel 112 by suitable coupling devices 120, 121 each of which can comprise a tongue on the vessel 112 and a bifurcated portion of the respective section 114, 115. The means 122 for coupling the section 116 of the right-hand encapsulating or confining means of FIG. 4 to the respective marginal portion of the vessel 113 is analogous to the coupling means 121. The vessels 112, 113 are, or can be, more or less permanently secured to the frame. The hoods including the sections 114, 115 cooperate with the vessel 112 to prevent appreciable evaporation of solvents from printing ink in the recesses of the roller 16s. The vessel 113 cooperates with the hood section 116 and with the other (non-illustrated) hood section for the roller 16d to prevent excessive evaporation of solvents from the ink which is carried by the recesses in the roller 16d. The coupling means allow for rapid and convenient attachment or separation of hood sections from the respective vessels of the encapsulating or confining means for the rollers 16d and 16s.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of our contribution to the art and, therefore, such adaptations should and are intended to be comprehended within the meaning and range of equivalence of the appended claims.

We claim:

1. Apparatus for applying printed matter to a running web of paper or the like, particularly an imprinter, comprising a frame; means defining a path for the web, including a counterpressure cylinder having coaxial first and second end portions; first and second levers rotatably supporting the respective end portions of said cylinder; pivot means for said levers, said pivot means defining an axis which is parallel to the common axis of said end portions; means for movably supporting said pivot means in said frame, including carriage means for said pivot means and guide means provided in said frame and defining for said carriage means a course extending at right angles to the axis of said pivot means;

and first and second printing cylinders installed in said frame and flanking said counterpressure cylinder, said printing cylinders having axes which are parallel to the common axis of said end portions.

2. The apparatus of claim 1, wherein said axes are horizontal and said course is substantially vertical, said frame having two spaced-apart sidewalls and said cylinders being disposed between said sidewalls.

3. The apparatus of claim 2, wherein said frame has a pair of aligned sockets for each of said printing cylinders and said printing cylinders have end portions in the respective sockets, each of said sockets having an open side to allow for insertion or removal of the end portions of the respective printing cylinders from the corresponding pairs of sockets.

4. The apparatus of claim 3, wherein each of said printing cylinders has bearings surrounding the respective end portions, said bearings being disposed in the respective sockets and being insertable into and removable from the respective sockets by way of the corresponding open sides.

5. The apparatus of claim 2, further comprising a support in said frame beneath each of said printing cylinders, guide means defining for said supports substantially vertical courses along which the supports are movable toward and away from said counterpressure cylinder, a holder mounted on each of said supports for pivotal movement about an axis which is substantially parallel to the axes of said printing cylinders, and sources of printing ink provided on said holders.

6. The apparatus of claim 5, further comprising motor-operated means for moving said supports along the respective courses.

7. The apparatus of claim 6, wherein said moving means comprises at least one rotary feed screw.

8. The apparatus of claim 2, further comprising means for releasably clamping said carriage means to said guide means.

9. The apparatus of claim 8, wherein said clamping means comprises fluid-operated motor means.

10. The apparatus of claim 2, further comprising a prime mover, first and second motors, first and second clutch means engageable to releasably couple said first and second motors to said first and second printing cylinders, respectively, so as to accelerate the respective printing cylinders, and second and third clutch means engageable to respectively couple the accelerated first and second printing cylinders to said prime mover.

11. The apparatus of claim 10, wherein at least one of said motors is a variable-speed motor.

12. The apparatus of claim 2, further comprising motor means for pivoting said counterpressure cylinder about the axis of said pivot means and adjustable stop means for limiting the extent of pivotability of said counterpressure cylinder.

13. The apparatus of claim 2, further comprising at least one ink supplying cylinder at a level below each of said printing cylinders, means for pivotably mounting said ink supplying cylinders in said frame for movement about axes which are parallel to the axes of said printing cylinders, means for pivoting said ink supplying cylinders, and adjustable stop means for limiting the extent of pivotability of said ink supplying cylinders.

14. The apparatus of claim 2, further comprising motor means for moving said supporting means up and down, at least one substantially vertical feed screw in said frame, a pin-and-slot connection between said feed screw and said supporting means, and means for rotating said feed screw.

15. The apparatus of claim 14, wherein said means for rotating the feed screw comprises a worm wheel on the feed screw and a motor-driven worm mating with said worm wheel.

16. The apparatus of claim 1, further comprising means for rotating said counterpressure cylinder independently of said printing cylinders.

17. The apparatus of claim 16, wherein said means for rotating the counterpressure cylinder comprises a variable-speed motor.

18. The apparatus of claim 1, further comprising means for rotating said printing cylinders and said counterpressure cylinder independently of each other.

19. The apparatus of claim 18, wherein said rotating means comprises a variable-speed motor for said counterpressure cylinder and additional variable-speed motors for said printing cylinders.

20. The apparatus of claim 1, wherein said printing cylinders are rotogravure rollers and further comprising means for supplying printing ink to said printing cylinders and a squeegee cooperating with each of said printing cylinders to remove the surplus of printing ink.

21. The apparatus of claim 20, wherein each of said printing cylinders has an upper portion and a lower portion, said squeegees being adjacent the upper portions of the respective printing cylinders and further comprising means for collecting printing ink which is removed by said squeegees and means for directing removed printing ink from said squeegees into said collecting means.

22. The apparatus of claim 20, wherein each of said printing cylinders has an upper portion and a lower portion, said squeegees being adjacent the lower portions of the respective printing cylinders and forming compact modules with the respective ink supplying means.

23. The apparatus of claim 20, further comprising means for encapsulating each of said printing cylinders and the respective ink supplying means and squeegees.

24. The apparatus of claim 23, wherein each of said encapsulating means comprises a vessel for the respective squeegee and ink supplying means, a hood, and means for separably coupling the hood to the respective vessel.

* * * * *